United States Patent [19]

Baity et al.

[11] Patent Number: 4,710,602

[45] Date of Patent: Dec. 1, 1987

[54] ILLUMINATED ROCKER SWITCH ASSEMBLY

[75] Inventors: Donald N. Baity; Gregory J. Schwandt, both of Kokomo; Charles E. Kidwell, Greentown, all of Ind.

[73] Assignee: General Motors Corporation, Detroit, Mich.

[21] Appl. No.: 825,151

[22] Filed: Feb. 3, 1986

[51] Int. Cl.[4] ..... H01H 9/00

[52] U.S. Cl. ..... 200/315; 200/339; 200/5 A

[58] Field of Search ..... 200/310, 313, 314, 315, 200/339, 159 B, 5 A, 302.3

[56] References Cited

U.S. PATENT DOCUMENTS

| | | | |
|---|---|---|---|
| 3,144,643 | 8/1964 | Andersson | 200/314 |
| 3,654,415 | 4/1972 | Hawkins et al. | 200/302.3 |
| 3,691,324 | 9/1972 | Brantingson | 200/5 A |
| 4,029,915 | 6/1977 | Ojima | 200/5 A |
| 4,029,925 | 6/1977 | Biske | 200/339 |
| 4,215,257 | 7/1980 | Repplinger | 200/153 T |
| 4,401,864 | 8/1983 | Ichikawa | 200/17 R |
| 4,425,487 | 1/1984 | Hsieh | 200/153 K |

*Primary Examiner*—Henry J. Recla
*Assistant Examiner*—Linda J. Sholl
*Attorney, Agent, or Firm*—Warren D. Hill

[57] ABSTRACT

A rocker switch assembly includes a rocker pivoted about a central axis, an actuator responsive to the rocker and pivoting about either end, and conductive rubber push-button switches selectively operated by the actuator with minimum lateral deformation. The actuator is translucent to serve as a light conductor to carry light from an adjacent lamp to the rocker which bears translucent legends. The actuators of adjacent pairs of switch mechanisms are lit by a single lamp between them.

6 Claims, 9 Drawing Figures

ILLUMINATED ROCKER SWITCH ASSEMBLY

FIELD OF THE INVENTION

This invention relates to rocker switch assemblies and particularly those which selectively actuate either of a pair of switches and which have optional rocker illumination.

BACKGROUND OF THE INVENTION

Push-button switches of the elastomeric dome variety are convenient to use in many applications where manual switching is required since they provide tactile feedback to the user and they can be manufactured in arrays which are easy to assemble to multiple switching panels. Furthermore, they are readily secured to printed circuit boards. Such switches exhibit long life when properly used but they have the disadvantage that lateral deformation during operation tends to shorten switch life and cause poor switch contact. Although some lateral travel during switch operation is allowable it is desirable to minimize it.

Rocker switch actuators are a preferred switch style where the switching function is to make a choice between two mutually exclusive operations. The rocker should be pivoted at a central axis so that upon actuation it has a definite motion in either direction and does not experience a net movement inward, that is, when one end of the rocker is pushed in the other end will move out by an equal amount. This provides the best tactile feel to the user and it insures that only one switch at a time can be operated. It is known to use a rocker to actuate push-button switches and the elastomeric dome switches may be used in combination with a rocker. Unfortunately the angular movement of the rocker inherently results in a component of lateral travel to therefore laterally deform the dome switch. It is desirable then to minimize the effects of lateral travel of the rocker to assure that the limits of the dome switch are not exceeded.

Often it is desirable to illuminate a switch actuator to display a legend. It is known to provide a small lamp within a switch assembly and a translucent region on the actuator to effect illumination. While this can be done in the case of a rocker switch the resulting assembly is complicated and expensive.

SUMMARY OF THE INVENTION

It is therefore an object of the invention to provide a rocker switch mechanism for actuating push-button switches with a minimum of lateral travel.

It is another object to illuminate a rocker switch from a light source external to the switch mechanism.

It is a further object to utilize a common element to effect the illumination and travel limiting functions in a rocker switch.

The invention is carried out by a manually operated switch assembly for selectively actuating a pair of switches, comprising a housing defining an aperture, a circuit board opposite the aperture, a pair of resilient push-button switches mounted on the circuit board, a rocker pivotally mounted in the aperture of the housing for movement about a fixed axis at the center of the aperture, and an actuator between the rocker and the switches having a pivot axis at each end for pivoting in a first direction about one end to actuate one of the switches when the rocker is pivoted about its axis in the first direction and for pivoting about the other end in a second direction to actuate the other of the switches when the rocker is pivoted in the second direction, whereby the resilient switches are selectively actuated when the rocker is pivoted.

The invention is further carried out by the switch assembly described above wherein the rocker has a face bearing a translucent indicia, a light source is mounted on the circuit board laterally adjacent the actuator, and the actuator comprises a transparent light conducting material for carrying light from the light source to the rocker to illuminate the indicia.

BRIEF DESCRIPTION OF THE DRAWINGS

The above and other advantages of the invention will become more apparent from the following description taken in conjunction with the accompanying drawings wherein like reference numerals refer to like parts and wherein.

DESCRIPTION OF THE PREFERRED EMBODIMENT

Figure 1:
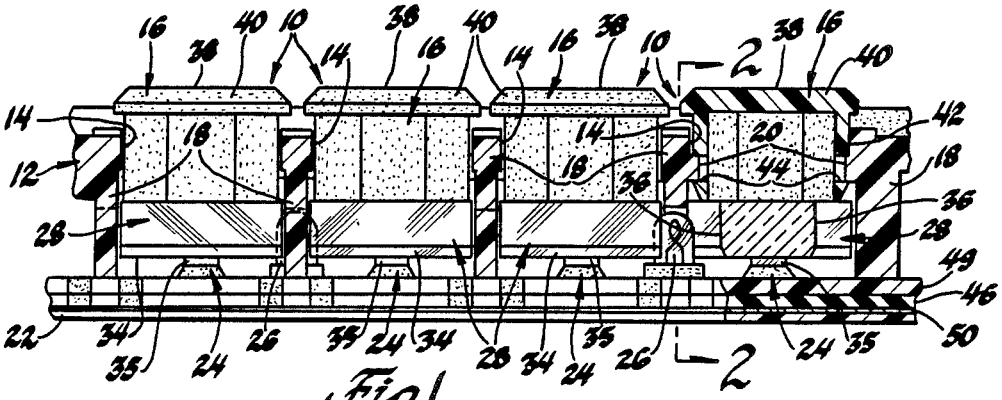
FIG. 1 is a cross-sectional end view of a rocker switch assembly according to the invention.
Figure 2:
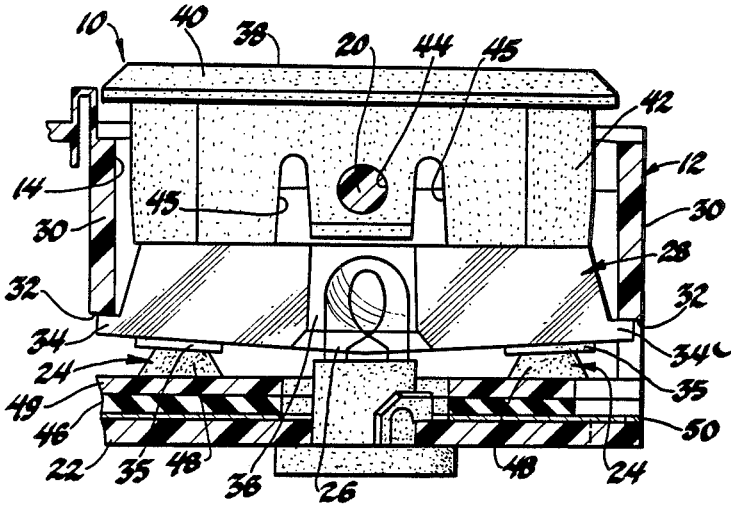
FIG. 2 is a side view of the assembly of FIG. 1 taken along line 2—2.
Figure 3:
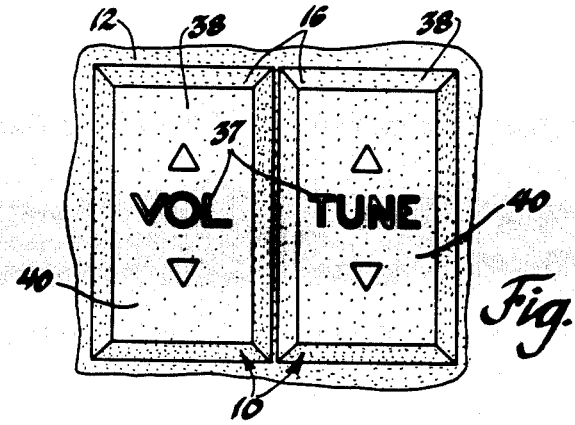
FIG. 3 is a top view of a portion of the assembly of FIG. 1.
Figure 4:
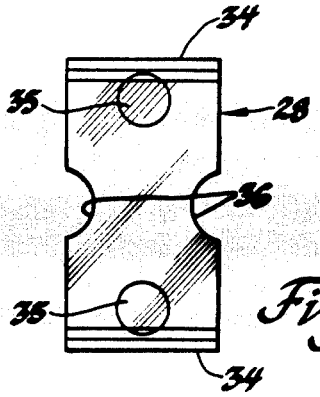
FIG. 4 is a top view of an actuator of the switch assembly.

As shown in FIGS. 1, 2, 3 and 4 a linear array of switch mechanisms 10 are supported by a housing 12 having a plurality of apertures 14 each containing a rectangular rocker 16 pivotally mounted to housing walls 18 by pins 20 extending from the walls. One side of the housing 12 is closed by a printed circuit board 22 which is secured by means, not shown, to the housing. The circuit board 22 carries a plurality of push-button switches 24 as well as lamps 26 which are disposed between adjacent pairs of switch mechanisms 10. The switches 24 are arranged in pairs, each pair being operated by one rocker. An actuator 28 molded of a transparent plastic material has the general rectangular shape of the rocker and is disposed between each rocker 16 and its corresponding switches 24. Housing walls 30 which extend along each end of the rockers and actuators define shoulders 32 facing the circuit board 22. The shoulders 32 engage the ends of the actuators 28 so that the shoulders as well as the rockers hold the actuators against the switches. Since the switches 24 are resilient the actuators can be biased lightly against them to hold the parts firmly and prevent rattling. A switch compression of about 0.1 mm is sufficient for this purpose.

The actuators 28 each have a lower flange 34 protruding from each end for engagement with the shoulders 32. The contact line between the flange and the corresponding shoulder provides a pivot axis for movement of the actuator when the rocker depresses one end of the actuator to close a switch. The resilient switches 24, when depressed, provide return force to maintain the actuators and rockers in neutral position in the absence of an operator force. A pair of buttons 35, integral with each actuator, are positioned to contact the switches 24. A semi-circular recess 36 in each side of the actuator allows the actuator to partially surround an adjacent lamp 26 for efficient light gathering. While only one side requires such a recess 36 the symmetrical design allows easy assembly of the actuator. One lamp is sufficient to illuminate an adjacent pair of switch mechanisms. Light entering the transparent actuator is directed toward the rocker 16 which has a translucent legend 37 on its outer or "top" surface. The top 38 of the rocker is formed of a translucent plastic material covered by paint 40 or other masking material or applique in a pattern to define a desired legend 37 so that light is emitted from the unmasked portions. A laterally extending flange surrounds the top 38 to extend beyond the apertures and prevent light leakage around the rockers. The remainder of the rocker 16 comprises a thin walled rectangular skirt portion 42 secured to the top 38. An aperture 44 in the center of each side of the skirt portion 42 is pivotally mounted to the pins 20 of the housing. Slots 45 on either side of the apertures lend enough flexibility to the aperture regions of the skirt to facilitate assembly.

Figure 5:
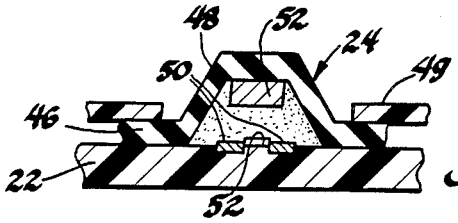
FIGS. 5, 6, and 7 are cross-sectional views of a push-button switch of the assembly shown in various conditions.
Figure 6:
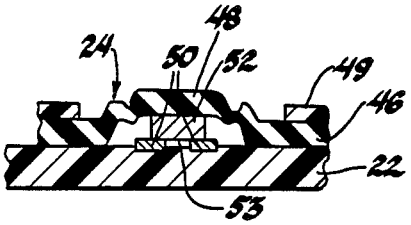
Figure 7:
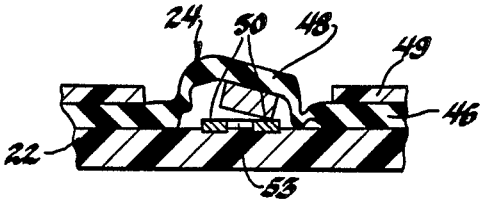

The switches 24, as best shown in FIGS. 5, 6 and 7, are commercially available keypad switches or conductive rubber dome switches. They comprise a sheet 46 of an elastomer, preferably silicone rubber, formed with a plurality of domes 48 in an array according to the desired switch layout. The sheet 46 is clamped to the circuit board 22 by a rigid plastic plate 49 which is secured to the circuit board 22. The circuit board carries conductor paths 50 to be connected upon switch closure. A conductive pad 52 in the center of each dome is arranged to bridge the conductor paths 50 upon depression of the dome 48. A vent 53 in the dome 48 prevents air pressure increase upon depression. As shown in FIG. 6, proper actuation of the dome switch results in complete switch closure. This requires that the dome be pushed in a direction substantially perpendicular to the circuit board. Only a small amount of lateral movement of the dome is permissible. FIG. 7 reveals the results of too much lateral movement during switch depression: the conductive pad 52 is tilted to make poor contact or no contact with the circuit runners. The improper deformation of the dome walls also causes wall fatigue and deterioration of the switch function.

The combination of the rocker 16 and the actuator 28 provides superior switch performance as well as a simple illumination scheme. It is required that the rocker be able to close only one switch at a time to avoid ambiguous signals arising from both switches being closed. This requirement is met by the central pivot of the rocker 16 which can rotate either clockwise or counterclockwise to close either switch but not both. The actuator 28 pivots about one end flange 34 and a shoulder 32 in response to the rocker movement to depress the switch at its moving end. The switch could have been depressed by the rocker directly if the actuator 28 had been omitted from the design. In that case, however, the rocker would experience a substantial lateral movement at its point of contact with the switch 24 and transfer that movement to the switch to cause the type of deformation which is sought to be avoided. The actuator, on the other hand, experiences much less lateral travel for the same amount of travel normal to the circuit board.

Figure 8:
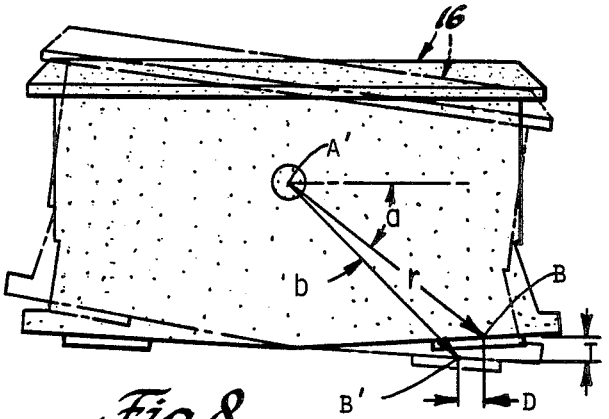
Fig. 8 PRIOR ART
FIGS. 8 and 9 are illustrations of switch assembly operation contrasting the invention and the prior art.
Figure 9:
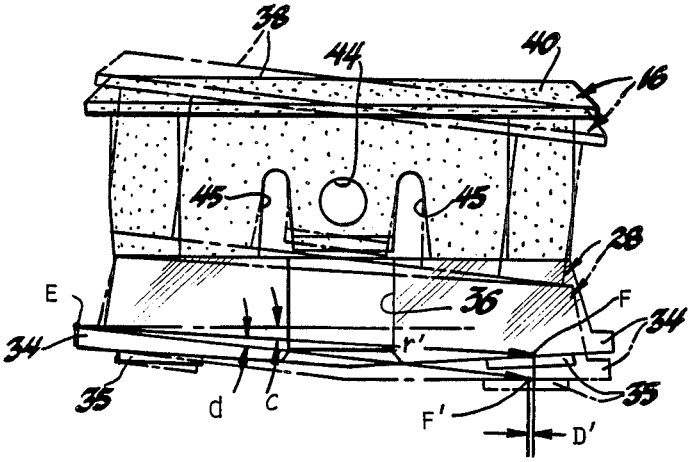

The diagrams of FIGS. 8 and 9 illustrate geometrical reasons for the improved switch operation. The prior art arrangement represented by FIG. 8 shows the movement of a switch rocker 16' as it would be designed in the absence of an actuator 28, the spacing between the rocker surface and the circuit board remaining the same as in FIG. 1. In FIG. 8, A is the pivot point and B is the contact point with the switch 24 in switch open position and B' is the contact point for switch closed position. With the plane of the circuit board defining the horizontal, the vertical distance T is the switch travel required for switch closure and the horizontal distance between B and B' is the lateral movement D of the contact point. The distance between A and B is r. The line A-B lies at an angle a below the horizontal and the rocker moves through an angle b to achieve the travel T. The distance D is $r[\cos a - \cos(a+b)]$. The lateral movement D thus increases with increase of either angle a or b.

The actuator movement according to this invention, represented by FIG. 9, requires smaller angles corresponding to a and b and results in a smaller lateral movement D' even though the lever arm is longer. E is the actuator pivot point, F and F' are the switch contact points for switch open and closed positions, and the distance E-F is r'. The actuator angular movement is d. The angle c of line E-F below the horizontal is very small due to the position of the pivot axis on shoulder 32 which is very close in the vertical direction to the plane of the switch contact points. The distance D' is $r'[\cos c - \cos(c+d)]$. For values $r=14$ mm, $T=1.3$ mm, and $a=37.6°$, then $b=8.4°$ and $D=1.37$ mm. For $r'=25$ mm, $c=4.6°$, $d=3.5°$ and $D'=0.16$ mm. Thus the actuator reduces the lateral movement at the contact point by a factor of eight. This improvement is sufficient to insure switch operation with good electrical contact and good tactile feedback.

It will be seen that the switch mechanism described herein is particularly useful for operating keypad switches in pairs for mutually exclusive operation while minimizing the lateral deformation of the switches and simultaneously providing convenient illumination of legends on the switch rocker.

The embodiments of the invention in which an exclusive property or privilege is claimed are defined as follows:

1. A manually operated switch assembly for selectively actuating a pair of switches, comprising;

a housing defining an aperture, a circuit board mounted in said housing opposite the aperture, a pair of resilient push-button switches mounted on the circuit board, each switch defining a switch contact point thereon, a rocker pivotally mounted in the aperture of the housing for movement about a fixed axis at the center of the aperture, and an actuator between the rocker and the switches, each end of the actuator continuously engaging one of said switches at said switch contact points and further engaging the housing at points in substantial alignment with the switch contact points to define pivot axes for the respective opposite ends of the actuator, whereby upon rocker movement against one end of said actuator, said actuator rotates about the pivot axis at the other end of said actuator, said switches being such that lateral movement of the actuator at the switch contact point is minimized.

2. A switch assembly as claimed in claim 1 wherein the switches are an elastomeric dome type with low tolerance to lateral deformation.

3. A switch assembly as claimed in claim 1 wherein the switches are an elastomeric dome type with low tolerance to lateral deforxation, the housing has a shoulder facing the circuit board disposed at each end of the actuator and the actuator is trapped between the resilient switches and the shoulders so that when one end of the actuator is depressed by the rocker to actuate a switch the other end pivots about the adjacent shoulder so that lateral movement at the one end depressing the switch is minimized.

4. A switch assembly as claimed in claim 1 wherein the rocker has a face bearing a translucent indicia, a light source is mounted on the circuit board, and the actuator comprises a transparent light conducting material for carrying light from the light source to the rocker to illuminate the indicia.

5. A switch assembly as claimed in claim 3 wherein the rocker has a face hearing a translucent indicia, a light source is mounted on the circuit board, and the actuator comprises a transparent light conducting material for carrying light from the light source to the rocker to illuminate the indicia.

6. A manually operated switch assembly for selectively actuating two pairs of switches, comprising;

a housing defining a pair of adjacent apertures;

a circuit board mounted in said housing opposite the apertures, two pairs of resilient push-button switches, each pair mounted on the circuit board opposite an aperture, each switch defining a switch point thereon, a common light source mounted on the circuit board between the pairs of switches, a pair of rockers each having a face bearing translucent indicia, means for pivotally mounting a rocker in each aperture of the housing for movement about a fixed axis at the center of the aperture, and a pair of transparent actuators each mounted between the rockers and the corresponding switches and on opposite sides of the light source and serving as light conductors to illuminate the indicia, each end of each actuator continuously engaging a pair of switches at said switch contact point and further engaging the housing at points in substantial alignment with the switch contact points to define pivot axes for the respective opposite ends of the actuators, whereby upon rocker movement against one end of said actuators, said actuators rotate about the pivot axis at the other end of said actuators, said switches being actuated by movement of said actuator such that lateral movement of the actuator at the switch contact point is minimized.

* * * * *